United States Patent [19]

Hollander

[11] Patent Number: 5,000,999

[45] Date of Patent: Mar. 19, 1991

[54] BITUMINOUS ROOF COVERING MATERIAL

[75] Inventor: Jan Hollander, Zuidhorn, Netherlands

[73] Assignee: B.V. Asphalt-en Chemische Fabrieken Smid & Hollander, Netherlands

[21] Appl. No.: 358,981

[22] Filed: May 30, 1989

[30] Foreign Application Priority Data

Jul. 12, 1988 [DE] Fed. Rep. of Germany ... 8808918[U]

[51] Int. Cl.[5] ..... B32B 3/10; B32B 15/08

[52] U.S. Cl. ..... 428/137; 428/192; 428/468; 428/489

[58] Field of Search ..... 428/498, 137, 192, 131, 428/489, 468

[56] References Cited

U.S. PATENT DOCUMENTS 3,922,417 11/1975 Reintjes et al. ..... 428/192
4,287,248 9/1981 Gessner et al. ..... 428/489 X
4,343,847 8/1982 Meynard ..... 428/139
4,819,848 4/1989 Hollander ..... 225/96
4,874,652 10/1989 Hollander ..... 428/137

FOREIGN PATENT DOCUMENTS 2457767 12/1980 France .
2478709 9/1981 France .

*Primary Examiner*—Thomas J. Herbert
*Attorney, Agent, or Firm*—Townsend and Townssend

[57] ABSTRACT

A bituminous roof covering material, particularly suitable for use as first layer in a multilayer roof covering system which is applied while adding heat. The material comprises a carrier provided on both sides with a bituminous layer and with a layer formed by a perforated metal foil. According to the invention, the carrier and the bituminous layers applied thereto on both sides are closed layers without perforations, and the bituminous layer interposed between the perforated layer and the carrier consists of adhesion-active bituminous material.

7 Claims, 1 Drawing Sheet

BITUMINOUS ROOF COVERING MATERIAL

The invention relates to a bituminous roof covering material, particularly suitable for use as first layer in a multilayer roof covering system which is applied while adding heat, comprising a carrier provided on both sides with a bituminous layer and with a layer formed by a perforated metal soil.

Such a roof covering material is known from Dutch patent application 85,01890. The known roof covering material is a completely perforated material which is designed for use as a vapour pressure distributing layer. The known material is suitably unrolled with the surface formed by a metal foil on the roof surface to be covered. Subsequently, a second layer is applied with a burner so as to heat the bituminous bottom side of the second layer whereby the material of the second layer can adhere to the roof at the perforations in the first layer. There is thus effectively obtained a sealing roof covering composed of two layers, said covering having vapour pressure distributing properties.

Although such a roof covering is very satisfactory, it has been found in practice that in certain cases there is a need for applying, instead of the perforated first layer, an entirely closed layer which, however, should have vapour pressure distributing properties.

It is an object of the invention to meet this need and, in general, to provide a roof covering material capable of being used as an effective vapour pressure distributing layer in a multilayer roof covering system, and allowing that a second layer is applied while adding heat. According to the invention a roof covering material of the type defined is characterized in that the carrier and the bituminous layers applied thereto on both sides are closed layers without perforations, and that the bituminous layer interposed between the perforated layer and the carrier consists of adhesion-active bituminous material.

It is observed that French patent application 2,556,392 discloses a roof covering material which in the position of use comprises a lowermost perforated layer and a cold adhesive layer immediately above the perforated layer. The perforated layer is composed of silicone-treated paper or synthetic material. This known roof covering material, however, cannot be applied while adding heat and is therefore also unsuitable for use in a multilayer roof covering system in which a second layer is transferred in accordance with the burning method or another method accompanied with heat supply.

The invention will now be described in more detail with reference to the accompanying drawings.

BRIEF DESCRIPTION OF THE DRAWINGS

FIG. 1 is a diagrammatic cross-sectional representation of a roof covering material according to the invention. The material shown comprises a carrier 1 of one of the materials suitable for the purpose, such as glass fiber, polyester and the like. On one side, which is the top side both in the drawings and in the position of use, the carrier 1 is provided with a bituminous layer 2 of a bitumen that may or may not be modified. Finally, the surface of the bituminous layer 2 facing away from the carrier is provided with a conventional mineral strewed layer 3. By way of alternative, one of the conventional cover foils can be used instead of the strewed layer.

Figure 1:
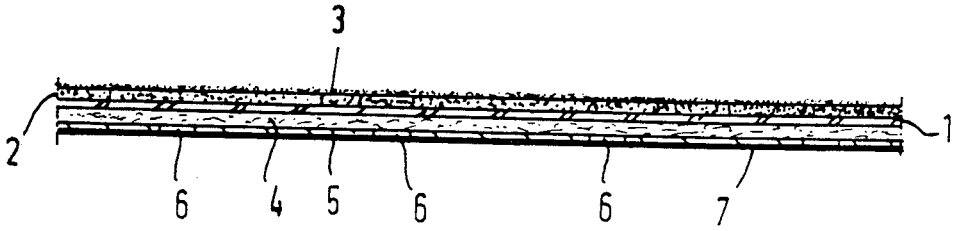
FIG. 1 is a diagrammatic cross-sectional representation of an example of a roof covering material according to the invention.

On the other side, the bottom side, the carrier 1 is provided with a layer 4 of strongly adhering bitumen compound, also called adhesion-active bitumen. Bitumen compositions suitable therefor are known per se. The layer 4 is provided at the surface facing away from the carrier with a perforated metal foil 5, e.g., aluminum foil with perforations 6. The foil is applied in such a manner that along at least one of the edges an edge region of the layer 4 is not covered.

In order to prevent the roof covering material from adhering to itself in the coiled state, the entire bottom side is covered with a separation foil or separation paper designated by 7. The separation layer 7 is removed before the roof covering material is applied to a roof surface to be covered.

Figure 2:
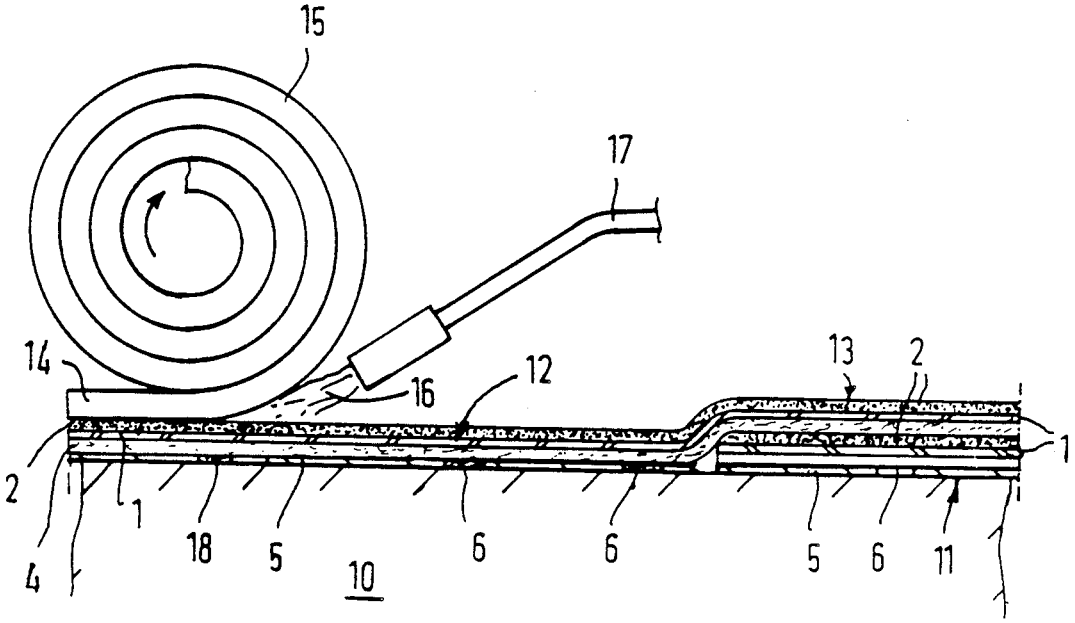
FIG. 2 is a diagrammatic illustration of an application of a roof covering material according to the invention.

FIG. 2 illustrates how to apply the roof covering material in a two-layer roof covering system. FIG. 2 shows a roof construction 10, on which lengths of the material according to the invention have been unrolled. After removal of the separation layer 7 a first length 11 is laid on the roof in the desired position. Subsequently, a second length 12 is laid on the roof adjacent to the first length. Both lengths are lying with the perforated layer 5 on the roof area. Moreover, the length 12 overlaps with the above part not covered by the perforated layer, the selvage 13, a corresponding edge region of the length 11, so that a completely sealing roof covering layer is obtained.

The adhesion to the roof area is established by supplying heat. This heat supply can take place advantageously during the application of a second layer of roof covering material 14 by means of the so-called burning method, as diagrammatically represented by FIG. 2. To this end, a coil 15 of suitable material is uncoiled over the roof already covered with the material according to the invention, while heat is supplied in the nip between the coil 15 and the material lying on the roof by means of a flame 16 from a burner 17. The bottom of the material on the coil is thereby effectively adhered to the top of the material according to the invention. In addition, the heat supplied and passed through causes the adhesion-active bituminous layer 4 to bond to the roof area at the perforations 6 in the perforated layer 5, as shown in FIG. 2 at 18.

The layer 5 prevents a permanent bond of the adhesion-active bitumen to the roof in the areas between the perforations, so that the vapour pressure distributing effect is ensured.

In principle, it is also possible to activate the adhesion-active layer by supplying heat in another manner, e.g., by spreading sufficiently hot bitumen over an applied layer of roof covering material according to the invention, or by heating the layer of roof covering material according to the invention with a burner without application of a second layer 14.

As may appear from the foregoing, the material according to the invention is, however, eminently suited for use as first layer in a two- or multilayer roof covering system in which the second layer is applied with a burner, because then both the vapour pressure distributing layer and the second layer can be applied in one operation.

It should be noted that after the foregoing different variants of the material according to the invention are obvious to a skilled worker. Thus, for instance, the perforated layer is preferably composed of aluminium foil indeed, but another metal foil is also applicable and even a foil of another suitable material which is sufficiently heat-resistant and cannot bond to a roof area. By way of example, reference is made to special plastics.

Furthermore, if desired, the carrier may also be formed by a metal foil, such as aluminum foil, or by another vapour-tight material, e.g., if a completely vapour-tight roof covering is desired.

I claim:

1. A bituminous roof covering material, particularly suitable for use as first layer in a multilayer roof covering system which is applied while adding heat, comprising a carrier provided on both sides with a bituminous layer, one of the bituminous layers having on its surface facing away from said carrier a layer formed by a perforated metal foil, the carrier and bituminous layers applied thereto on both sides being closed layers without perforations, and the bituminous layer interposed between the perforated layer and the carrier consisting of adhesion-active bituminous material activatable only by heat.

2. A bituminous roof covering material according to claim 1, characterized in that the perforated layer consists of aluminium foil provided with perforations (6).

3. A bituminous roof covering material according to claim 1, characterized in that the perforated layer (5) leaves clear an edge region (13) of the bituminous layer (4) interposed between the carrier (1) and the perforated layer.

4. A bituminous roof covering material according to claim 1, characterized in that a separation layer (7) to be removed before use is provided on the side of the perforated layer.

5. A bituminous roof covering material according to claim 1, characterized in that the bituminous layer located on the side of the carrier opposite to the side where the adhesion-active layer is located is provided with a finishing layer (3).

6. A bituminous roof covering material according to claim 1, characterized in that the carrier consists of a vapour-tight material.

7. A bituminous roof covering material according to claim 6, characterized in that the carrier consists of aluminium foil.

* * * * *